US005511403A

United States Patent [19]

Krymsky

[11] Patent Number: 5,511,403

[45] Date of Patent: Apr. 30, 1996

[54] APPARATUS AND METHOD FOR MAGNETICALLY APPLYING A LUBRICANT

[75] Inventor: Mark D. Krymsky, Philadelphia, Pa.

[73] Assignee: WM Technologies, Camden, N.J.

[21] Appl. No.: 322,266

[22] Filed: Oct. 13, 1994

Related U.S. Application Data

[63] Continuation-in-part of Ser. No. 102,287, Aug. 5, 1993, abandoned.

[51] Int. Cl.[6] ..... B21C 09/02

[52] U.S. Cl. ..... 72/42; 72/43; 252/19

[58] Field of Search ..... 72/41, 42, 43, 72/44, 46, 274; 118/623; 252/19, 26

[56] References Cited

U.S. PATENT DOCUMENTS

| | | | |
|---|---|---|---|
| 2,254,531 | 9/1941 | Kirchner et al. | 118/623 |
| 3,961,511 | 6/1976 | Wolfe | 72/42 |
| 4,317,428 | 3/1982 | Sander et al. | 118/623 |

FOREIGN PATENT DOCUMENTS

| | | |
|---|---|---|
| 224814 | 9/1990 | Japan . |
| 733755 | 5/1980 | U.S.S.R. . |

*Primary Examiner*—Lowell A. Larson

*Attorney, Agent, or Firm*—Norman E. Lehrer; Jeffrey S. Ginsberg

[57] ABSTRACT

A wire drawing apparatus includes a container having opposing front and rear sides. The front and rear sides each have an opening formed therein. A quantity of dry powdered lubricant is located in the container. A die is positioned adjacent the opening on the rear side of the container. A wire is inserted in the opening in the front side of the container. The wire is pulled through the container and through the die. A permanent magnet is adjustably mounted in the container. Both the wire and the dry lubricant are magnetized by the magnet thereby causing the wire and lubricant to be attracted to one another so that the lubricant is held by the wire as the wire is pulled into the die.

16 Claims, 3 Drawing Sheets

APPARATUS AND METHOD FOR MAGNETICALLY APPLYING A LUBRICANT

CROSS-REFERENCE TO RELATED APPLICATIONS

This application is a continuation-in-part of prior application Ser. No. 08/102,287, filed Aug. 5, 1993, now abandoned.

FIELD OF THE INVENTION

The present invention relates to a dry-type wire drawing apparatus and process for continuously cold-drawing a wire rod. More specifically, the invention relates to means for applying a lubricant to the wire during the drawing process.

BACKGROUND OF THE INVENTION

In cold-drawing wire, the diameter of the wire is reduced as it is pulled through a circular die. Dry lubricants, usually different kinds of soaps or fats, are applied between the wire and the die. These lubricants wet the surface of the wire and the die for decreasing the drawing force, die wear, and drawing temperature, all of which improve the quality of the drawn wire. Traditionally, dry lubricants, like powder or other granulated material, are loaded into a soapbox or similar container which is situated in front of the die. The lubricant is fed to the die by direct application to the surface of the wire which moves the lubricant into the die as the wire is drawn through. As a rule, the frictional forces between the lubricant and the wire are not adequate for feeding sufficient lubricant to the die by direct mechanical application. Frictional application forces against the wire are further reduced because sometimes the wire makes a channel in the dry lubricant reducing the contact friction and, hence, the lubricant feed to the die is further reduced.

There are many known methods to enhance feeding dry lubricant to the die, or applying it to the wire to carry the lubricant to the die. The most commonly used technique is the preliminary coating of the wire surface by materials, such as lime, borax or phosphate applied ahead of the soapbox which can improve the adhesion between the wire surface and the dry lubricant. Other attempts to improve wire lubrication include the mechanical feed of the dry powdered lubricant into the die by a power-driven, screw-type feeder located in the soapbox. Other methods employed to enhance the lubrication of the wire and the die also include mechanically coating the surface with a dry lubricant by (1) rotating a cylindrical soapbox; (2) vibrating the soapbox; and (3) using a special device which contains rotating rolls situated in the soapbox, such as the device produced by the Wire Lab Company, U.S.A., as Models LA-CW and LA-S.

The closest patent art pertinent to his invention of which the applicant is aware includes the following. U.S. Pat. No. 3,142,832 discloses the use of an additional die, called a "pressure die", which is located in front of the usual die. The pressure die has a diameter hole slightly greater than the wire diameter. U.S. Pat. Nos. 2,135,659 and 2,883,039 disclose the method of preliminary wire bending before entry into the soapbox to make the trajectory of the wire movement through the dry lubricant more circuitous. U.S. Pat. Nos. 2,349,652 and 3,763,680 disclose using a special die with a particular entrance angle which together with a high drawing speed feeds dry powdered lubricant into the reduction angle of the die by pseudohydrodynamic force.

U.S. Pat. No. 3,703,449 discloses means for formation of lubricant coating on the wire by electrolysis.

Japanese published application No. 224814 to Misubishi Heavy Industries and Russian Patent No. 733755 to Refractory Met Allo show the use of magnets and magnetic lubricants. While these systems may provide some improvement, they suffer from various deficiencies. By way of example, the Japanese device utilizes a fixed magnet that is not adjustable and the Russian device utilizes a complex electromagnetic arrangement. Furthermore, the lubricants disclosed therein have not proven to be effective.

Using any of the above-described methods, does not solve the needs in the art of wire drawing which still require these attributes; reliable and sufficient feed of dry powdered lubricant into the die, a means for significantly reducing the cost of wire drawing, and finally a means for adjusting the quantity of lubricant fed into the die.

SUMMARY OF THE INVENTION

The above-described unsolved needs in the wire drawing art has been satisfied by the present invention employing a magnetic dry powdered lubricant which is attracted to the wire and fed into the die by the force of a magnetic field. As will be more fully described by the preferred embodiment, there are many alternative designs which can utilize this concept. In one embodiment, permanent magnets located on the soapbox body magnetize both a specially prepared magnetizable dry lubricant and the wire, which thus become attracted to each other. This magnetic attraction between the wire and the lubricant results in more lubricant being applied to the wire. In an alternative embodiment of the present invention, the quantity of magnetic lubricant fed to the die may be adjusted by changing the distance between the permanent magnets and the die, or changing the distance between the magnets and the wire. In either design, it should be understood that permanent magnets may be replaced by electromagnets. In that case, lubricant feed may also be controlled by varying the electric current to the electromagnet and, hence, the degree of attraction between the magnetic dry lubricant and the wire.

It is therefore a primary object of the present invention to produce a lubricant-applying system for wire-drawing that will increase the amount of lubricant applied to the wire which is ecologically safe and does not necessarily require additional energy.

It is a further object of the present invention to create a lubricating wire-coating system for wire drawing which will decrease die wear, maintain a high drawing speed, and produce a decreased drawing force on the die, thus decreasing power consumption.

It is yet a further object of the present invention to create a wire lubricating system which reduces wire breakage during the drawing process and also reduces wire-drawing temperatures, thus improving the quality of the drawn wire.

It is yet a further object of the present invention to produce a wire drawing lubricant feed system which is adjustable and which is independent of the drawing speed.

It is a final object of the present invention to create a wire lubricating system which provides a uniform coating of lubricant over the wire surface and which uses components having high reliability.

Other objects and advantages and novel features of the invention will become apparent from the following detailed description of the invention when considered in conjunction with the accompanying drawings.

DETAILED DESCRIPTION OF THE PREFERRED EMBODIMENT

Figure 1:
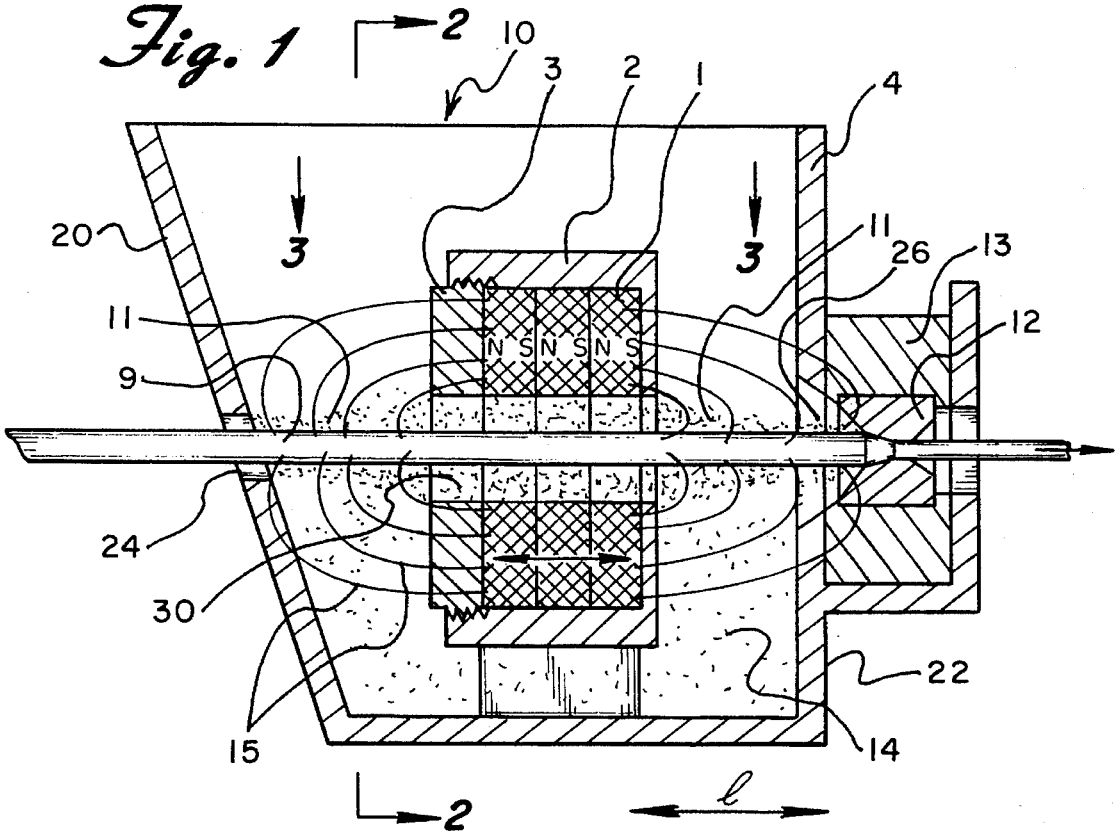
FIG. 1 is a side-sectional view of the present invention.

Referring now to the drawings in detail, wherein like reference numerals have been used throughout the various figures to designate like elements, there is shown in FIG. 1 a side cross-sectional view of an apparatus and method for magnetically applying a lubricant constructed in accordance with the principles of the present invention and designated generally as 10. The apparatus is comprised essentially of a soapbox or other container 4, a die 12 and a magnet structure 1 positioned in the container.

The container 4 has opposing front and rear sides 20 and 22, respectively. The front and rear sides each have a corresponding opening, 24 and 26, formed therein. The wire 9 to be drawn is inserted through opening 24 and is pulled through the opening 26 in the rear side 22 of the container 4 and through die 12 by means (not shown) well-known in the art.

The container 4 is filled with a quantity of dry magnetic lubricant 14 in an amount sufficient to completely surround the surface of the wire 9 to be drawn. The dry magnetic lubricant 14 includes a dry lubricant component and a magnetizable component each comprised of a plurality of particles. The stability of the mixture of these two components is ensured by the adhesion of the dry lubricant component to the magnetizable component. In the preferred embodiment, the dry magnetic lubricant is 90.0–99.75% by volume dry lubricant component and 0.25–10.0% magnetizable component. It should be noted that if the amount of the magnetizable component exceeds 10% by volume, the lubricating properties of the magnetic lubricant will be inadequate. Hence, die wear and wire temperature will increase and the quality of the treated wire will be inferior. Moreover, if the magnetizable component is less than 0.5% by volume, the dry magnetic lubricant will not sufficiently be attracted to the wire 9.

In the preferred embodiment, the magnetizable component is $Fe_2O_3$. However, a variety of other ferrites and ferromagnetic alloys can be used such as $Fe_3O_4$ or $CrO_2$. The magnetizable component preferably has a magnetic flux saturation of 3400 gauss and a coercivity of greater than 20 KA/m. However, satisfactory results will be achieved if the magnetizable component has a magnetic flux saturation in the range of 100 to 24500 gauss. The dry lubricant component and the magnetizable component are preferably made of a plurality of particles having a length of less than 5 microns and a length to width ratio in the range of between approximately 2 to 8. In addition, the particles preferably have a needle-like shape to ensure proper adhesion to the wire 9.

Figure 2:
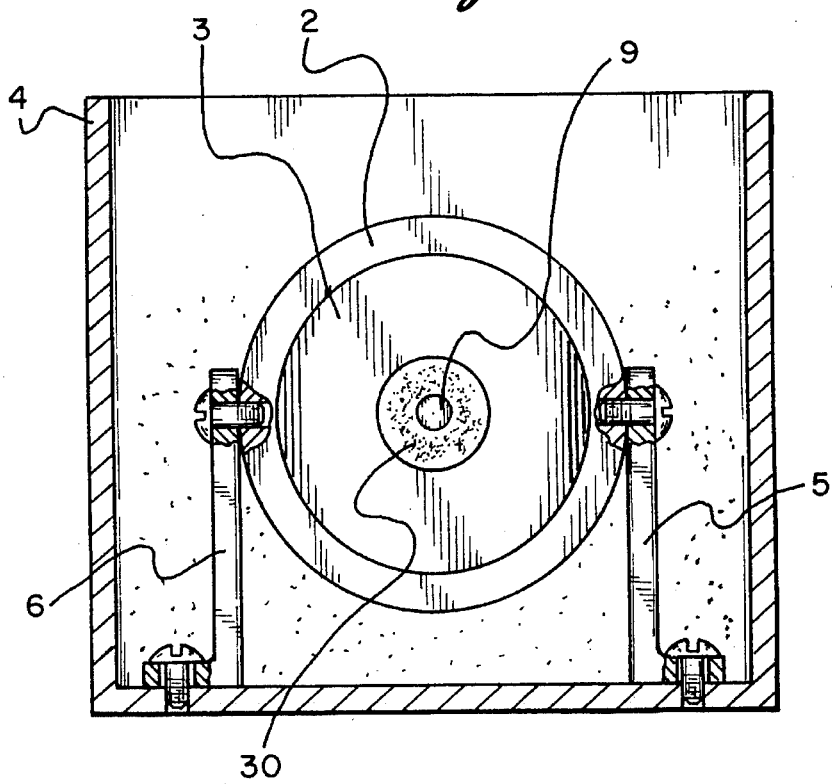
FIG. 2 is a front-sectional view taken from FIG. 1 as shown in that figure.

In the preferred embodiment, a magnet structure 1 is positioned in the container 4. The magnet structure is preferably an annular permanent magnet as illustrated in FIG. 2. The magnet 1 has an opening 30 formed therein. The wire 9 is preferably inserted through the opening 30 in the permanent magnet 1. The ring shape of magnet 1 ensures that the wire 9 will be uniformly coated with lubricant 14 as the wire is drawn. A nonferromagnetic housing 2 surrounds the magnet structure 1 and is enclosed by a nonferromagnetic end cover 3. The housing 2 is secured in the container by the use of mounting brackets 5 and 6 as illustrated in FIGS. 2 and 3.

Figure 3:
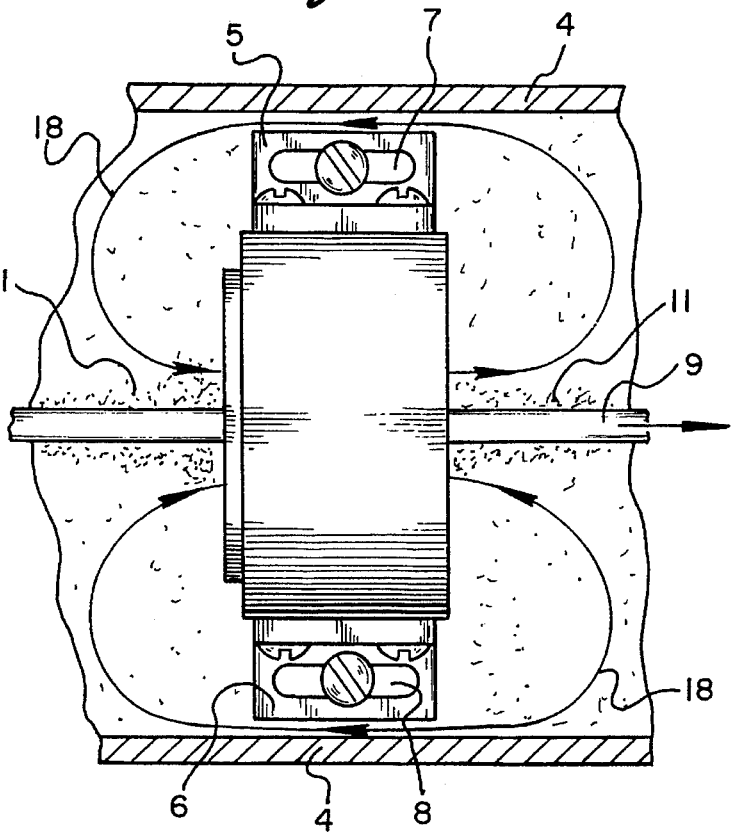
FIG. 3 is a top view of the present invention.

Each of the mounting brackets 5 and 6 includes a corresponding slot 7 and 8, respectively (see FIG. 3). Slots 7 and 8 allow the housing 2 and attached magnet structure 1 to be axially moved along the length of the inserted wire 9. Accordingly, the magnet structure can be positioned closer to or further from the die 12 to be lubricated. The ability to selectively locate the magnet structure 1 allows the quantity of lubricant fed to the die to be adjusted.

The annular permanent magnet 1 creates magnetic forces that are shown by the magnetic field lines 15 (see FIG. 1). The magnetic flux travels from the north pole of to the south pole of the magnet structure 1 through the magnetic dry lubricant 14 and the ferromagnetic wire 9. The magnetic flux magnetizes the magnetic dry lubricant 14 and the wire 9 thereby causing them to be attracted to one another. The amount of lubricant carried by the wire can be controlled by moving the magnet 1 closer to or further from the die 12. For example, the degree of attraction between the lubricant 14 and the wire 9 is higher closer to the magnet 1. Therefore, positioning the magnet 1 closer to the die 12 ensures that more lubricant will be carried by the wire to the die.

Figure 4:
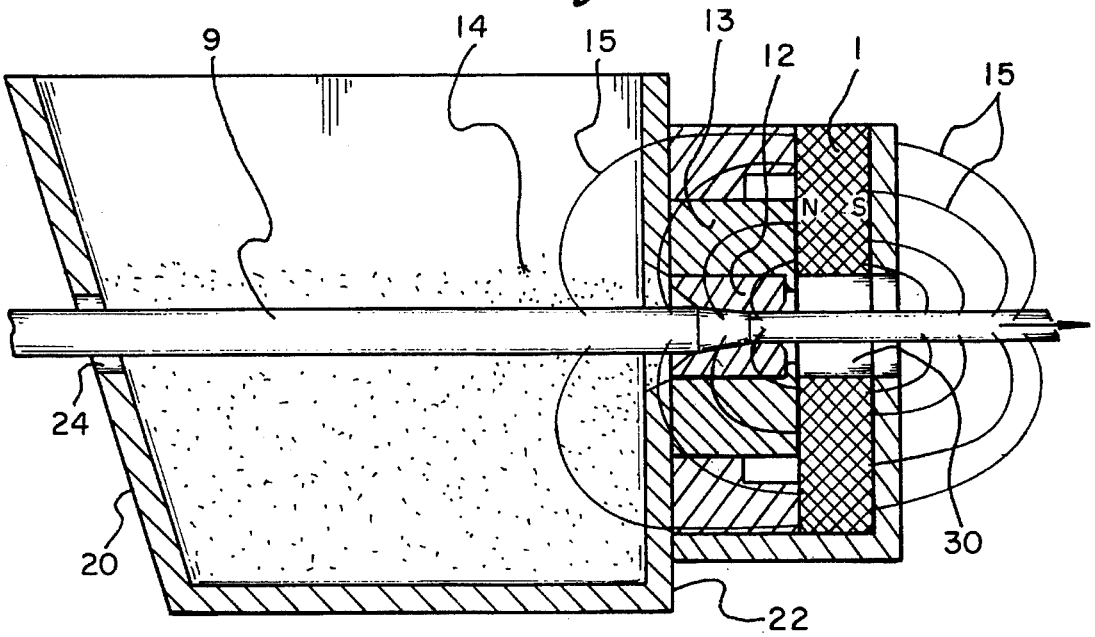
FIG. 4 is a side-sectional view of a still further alternate embodiment of the invention.

Referring to FIG. 4, an alternate embodiment is shown wherein the magnet structure 1 is affixed adjacent the die 12 outside the container 4. In this embodiment, the magnetic flux passes through the case 13 of the die 12, the magnetic lubricant 14 and the wire 9. The magnetic field 15 is directed to the die and the magnetic lubricant is thereby drawn both directly to the die 12 and by being carried by the wire 9.

Figure 5:
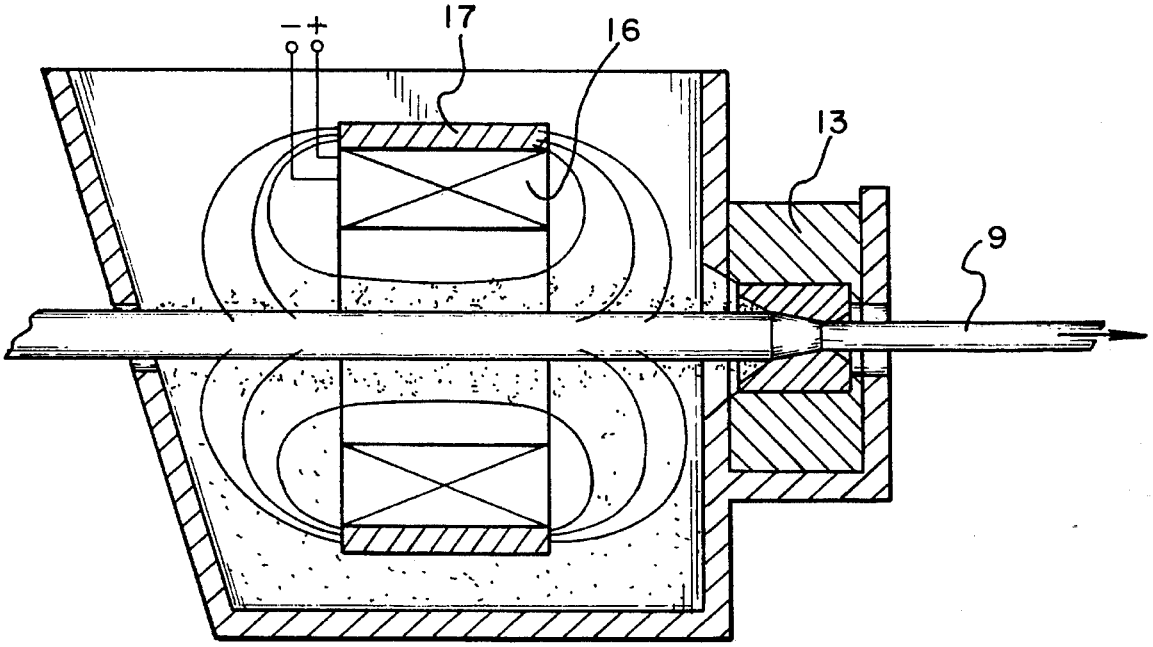
FIG. 5 is a side-sectional view of an alternate embodiment of the present invention.

In either of the embodiments shown in FIG. 1 or FIG. 4, an electromagnet may replace the permanent magnet as the source of the magnetic field as illustrated in FIG. 5. This also provides an added degree of control since a change in the magnetic force of the magnetic field can be made by adjusting the magnetizing electric current thereby changing the quantity of magnetic lubricant attracted to the surface of the treated wire.

The present invention may be embodied in other specific forms without departing from the spirit or essential attributes thereof and accordingly reference should be made to the appended claims rather than to the foregoing specification as indicating the scope of the invention.

What is claimed is:

1. A method of drawing a wire through a die, which comprises:

passing said wire into a container filled with a dry magnetic lubricant;

magnetizing said wire by passing the same through a magnetic field provided by a magnet means, said magnet means including adjustment means for varying the distance between said magnet means and said die;

attracting said magnetic lubricant to said magnetized wire, and directing said magnetic lubricant to said die by passing said wire through said die.

2. The method of claim 1 wherein said magnetizing field has a value of at least 100 gauss on the portion of the wire directly in front of said die.

3. The method of claim 1 wherein said magnet means includes a permanent magnet ring located in said container, said magnet ring having an opening formed therein, said wire passing through said opening of said permanent magnet ring.

4. The method of claim 1 wherein said magnet means includes a permanent magnet ring located outside said container adjacent said die.

5. The method of claim 1 wherein said magnetic lubricant includes a mixture of a dry lubricant powder and a magnetizable powder, said mixture having a saturation magnetic flux of between 100 and 24500 gauss, said mixture being 90.0–99.75% dry lubricant by volume and 0.25–10.0% magnetizable powder by volume.

6. The method of claim 5 wherein said dry lubricant powder and said magnetizable powder is comprised of a plurality of particles having a length of less than 5 microns and a length to width ratio in the range of between approximately 2 to 8.

7. A magnetic dry lubricant for wire drawing comprising a mixture of a dry lubricant powder and a magnetizable powder, said mixture having a saturation magnetic flux of between 100 and 24500 gauss, said mixture being 90.0–99.75% dry lubricant by volume and 0.25–10.0% magnetizable powder by volume.

8. The magnetic dry lubricant of claim 7 wherein said dry lubricant and magnetizable powder is comprised of a plurality of particles having a length of less than 5 microns and a length to width ratio of between approximately 2 to 8.

9. The magnetizable powder of claim 8 wherein said particles have a needle like shape.

10. The magnetic dry lubricant of claim 7 wherein said magnetizable powder has a coercivity of at least 20 KA/m.

11. The magnetic dry lubricant of claim 7 wherein said magnetizable powder is $Fe_2O_3$.

12. The magnetizable powder of claim 7 wherein said magnetizable powder is $Fe_3O_4$.

13. The magnetizable powder of claim 7 wherein said magnetizable powder is $CrO_2$.

14. A wire drawing apparatus comprising:

a container having opposing front and rear sides, each of said sides having an opening formed therein;

a quantity of dry powdered lubricant located within said container;

a die positioned adjacent said opening on said rear side of said container;

means for pulling a wire through said container and through said die, said wire entering said container through said opening in said front side and exiting through said opening in said rear side;

a magnet means positioned within said container, said wire and said dry lubricant being magnetized by said magnet means thereby causing said wire and said lubricant to be attracted to each other so that said lubricant is held by said wire as said wire is pulled into said die; and means for adjustably securing said magnet means in said container so that the distance between said magnet means and said die can be varied.

15. The apparatus of claim 14 wherein said magnet means is a permanent magnet having an opening formed therein.

16. The apparatus of claim 15 wherein said magnet means creates a magnetizing field of at least 100 gauss measured at the portion of the wire directly in front of said die.

* * * * *